US006799498B2

(12) United States Patent
Spiel

(10) Patent No.: US 6,799,498 B2
(45) Date of Patent: Oct. 5, 2004

(54) MICRO ADJUSTER FOR PAPER PUNCH DIE

(75) Inventor: Norton Spiel, Jamaica, NY (US)

(73) Assignee: Spiel Associates, Inc., Long Island City, NY (US)

( * ) Notice: Subject to any disclaimer, the term of this patent is extended or adjusted under 35 U.S.C. 154(b) by 0 days.

(21) Appl. No.: 10/057,372

(22) Filed: Jan. 25, 2002

(65) Prior Publication Data

US 2003/0140747 A1 Jul. 31, 2003

(51) Int. Cl.[7] ..... B26F 1/14
(52) U.S. Cl. ..... 83/687; 83/698.91; 83/699.41
(58) Field of Search ..... 83/691, 686, 699.31, 83/699.41, 687, 698.91, 527; 269/73, 246

(56) References Cited

U.S. PATENT DOCUMENTS 312,870 A * 2/1885 Linton et al. ..... 83/699.41
343,180 A * 6/1886 Leavitt et al. ..... 83/660
1,202,596 A * 10/1916 Shepard ..... 83/103
2,734,572 A * 2/1956 Pater ..... 83/694
2,930,271 A * 3/1960 Whistler, Sr. et al. ..... 83/619
3,241,353 A * 3/1966 Putetti ..... 72/482.4
3,312,461 A * 4/1967 Copron ..... 269/101
2002/0157517 A1 * 10/2002 Huang ..... 83/618
2002/0189420 A1 * 12/2002 Rosene et al. ..... 83/699.41

* cited by examiner

*Primary Examiner*—Kenneth E. Peterson
(74) *Attorney, Agent, or Firm*—Alfred M. Walker

(57) ABSTRACT

A micro adjuster laterally moves a paper punch die. A modified fixed bracket with a larger fine-threaded hole is used to retain a hollow micro adjuster screw which is engaged by the fine threads of the bracket. The retaining screw that attaches to the die now does so by being inserted through the hollow body of the micro adjuster screw and out of a clearance hole at the distal end. Fine lateral adjustments of lateral alignment between the paper to be punched and the die can now be performed by moving the die laterally.

16 Claims, 5 Drawing Sheets

FIG.2
(PRIOR ART)
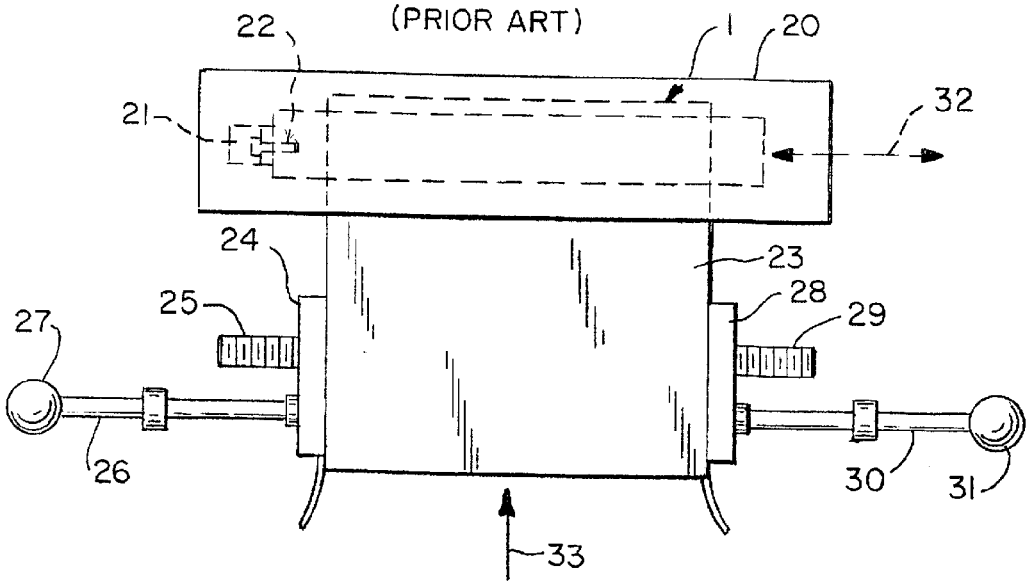
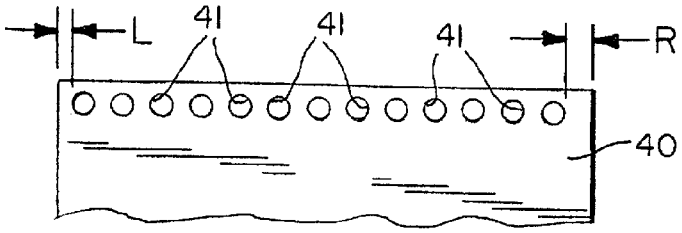
FIG.3
FIG.4
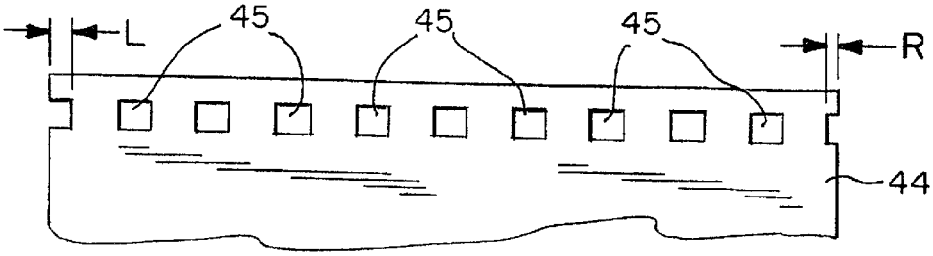

MICRO ADJUSTER FOR PAPER PUNCH DIE

FIELD OF THE INVENTION

The present invention relates to paper punch dies for making holes in sheets of paper.

BACKGROUND OF THE INVENTION

Automatic punches such as the Punchmaster 3120™ from Spiel Associates, Inc. are used primarily to punch a row of holes adjacent to the edge of a sheet of paper to facilitate binding, such as by using a spiral coil. The holes are punched by aligned pins which move in unison down and through the paper, thereby imparting punched holes therein.

One time consuming task during set-up is to center the punch pattern of the holes to be punched with respect to the edge of the paper. To facilitate the initial adjustment as well as subsequent fine adjustments, a left side guide and a right side guide are used together with scales imprinted with paper width sizes, which are useful for initial setting. The guides are set on either side of the paper sheets to guide them properly in a centrally aligned manner through the punching die.

While other suitably rigid and stress-resistant materials may be used, typically, the punching die is made of cast iron.

These side guides are used to put the proper side forces on the paper so as to eliminate lateral shifting without undue buckling. Since each edge must be adjusted separately, any slight lateral shifting of one guide to adjust the hole pattern centering must be accompanied by a corresponding shift of the opposite side guide while maintaining proper side forces. Therefore all of these adjustment parameters are interactive.

This adjustment process is iterative and tedious. Since punch dies have slight variations in their alignment on different machines, the process must be repeated every time a punch die is changed. Of course, the process must also be repeated every time the paper width is changed.

OBJECTS OF THE INVENTION

It is therefore an object of the present invention to provide an adjustment mechanism for accurately aligning a paper punch die with the sheets of paper to be punched with holes by the paper punch die.

It is also an object of the present invention to minimize adjustment of a paper punch die during extended use.

SUMMARY OF THE INVENTION

In keeping with these objects and others which may become apparent, the present invention provides a micro adjuster for laterally moving the punch die in alignment with the sheets of paper to be punched.

Normally a plurality of punch pins are provided to punch a plurality of holes in the sheets of paper, for example, along a side edge having a hole pattern for insertion of a fastener, such as a plastic or metal spiral coil of a spiral bound book, or rings of a loose leaf ring binder. However, even a single punch pin can be used if the sheets of paper are to be held by a single fastener, such as a corner clip. Moreover, the present invention can also be used just for aligning pages together needing a single cover page, having a single cut-out window for viewing a title on a page underneath the first cover page with the window.

The present invention can be used to punch holes that need to be accurately aligned, for example, a double loop wire binding, plastic comb binding, a VELO® machine binding, calendar holes and many other applications for aligning holes in sheets of paper.

The present invention is an improvement over earlier machines which lock the punch die laterally in a fixed position by attaching it to a fixed end bracket with a retaining screw.

In contrast, in the present invention, a modified fixed bracket with a larger fine-threaded hole is used to retain a hollow micro adjuster screw which is engaged by the fine threads of the bracket. The retaining screw that attaches to the punch die now does so by being inserted through the hollow body of the micro adjuster screw and out of a clearance hole at the distal end. In this manner, fine lateral adjustments of lateral alignment between the paper to be punched and the punch die can now be performed by moving the punch die laterally.

This is done by loosening the punch die retainer screw and using the disk shaped knurled wheel on the end of the micro adjuster screw. A wrench, such as a long allen wrench, is then used to retighten the die retaining screw. Then test punches can be made and a quick readjustment performed if required.

All this is done without touching either of the side guides at the edges of the paper. Therefore, the paper side guides are used only for initial set-up whereby the paper is approximately centered, and adjustment for proper side guidance forces is performed. Fine lateral adjustment of the hole pattern is performed by moving the punch die laterally using the micro adjuster of this invention.

BRIEF DESCRIPTION OF THE DRAWINGS

The present invention, can best be understood in connection with the accompanying drawings, in which:

FIG. 2 is a top plan view detail of a prior art automatic punch showing the relation of the punch die to the paper being punched;

FIG. 3 is a detail view of a round hole pattern in a sheet of paper when the left margin of the hole pattern is narrower than the right margin of the hole pattern of the hole-punched paper, wherein the margin is the distance from the first or last hole to the top or bottom of the sheet of paper;

FIG. 4 is a detail view a of rectangular hole pattern in a sheet of paper where a wide die is used;

DETAILED DESCRIPTION OF THE INVENTION

Figure 1:
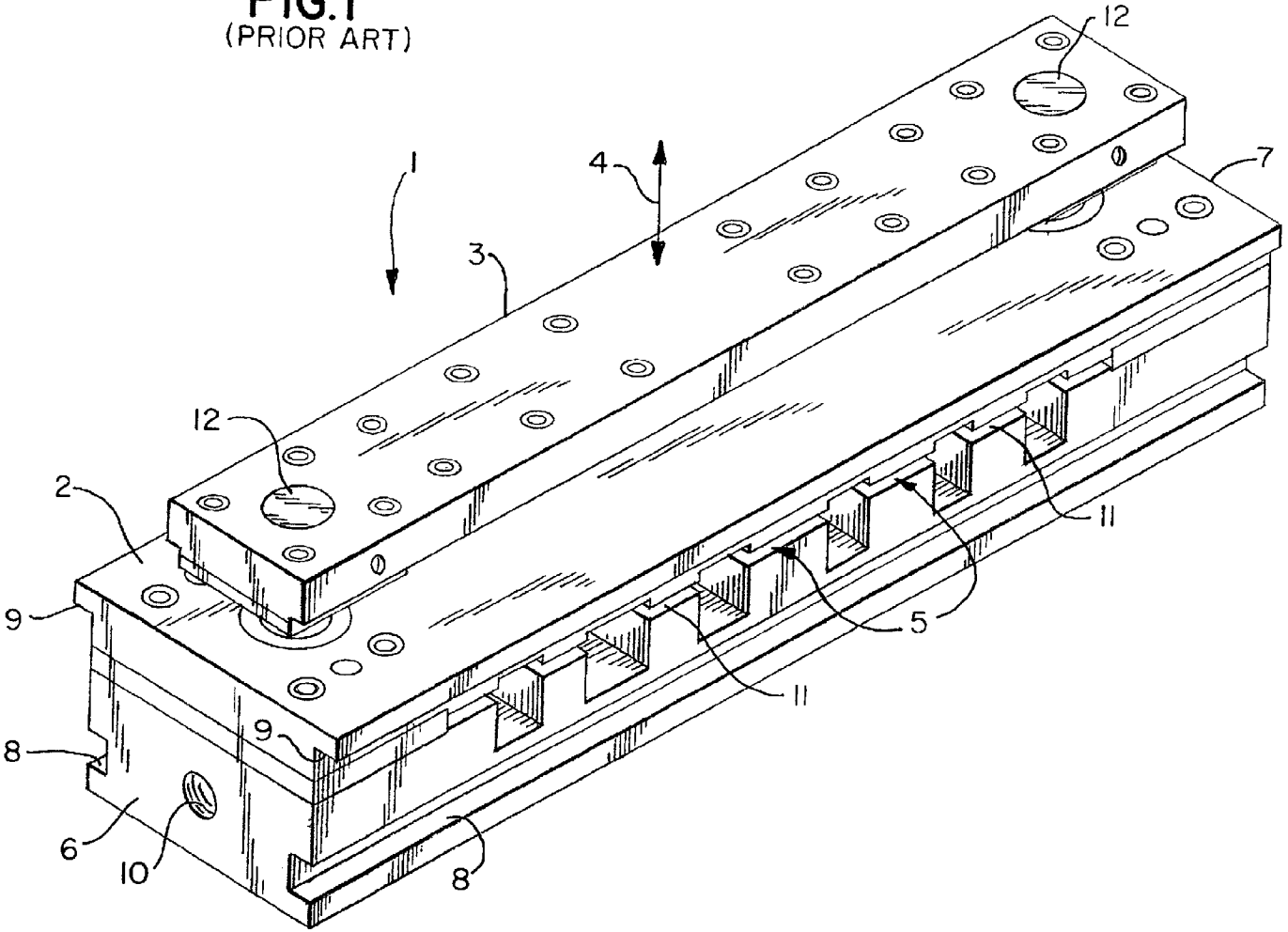
FIG. 1 (PRIOR ART)
FIG. 1 is an isometric view of a prior art hole punch die.

FIG. 1 shows a typical prior art punch die 1 used for punching hole patterns in paper. The fixed portion 2 of punch die 1 has several notable features and includes the stripper plate on top with engagement wings 9, a spacer plate which creates paper window 5 (through which paper is passed at opening 11) and a base portion with guidance channels 8. The pin bar/pin holder 3 is moved up and down by the punch mechanism as guided by guide posts 12. Both the proximal end 6 and the distal end 7 have threaded holes 10. On one end, hole 10 is used to accept a temporary handle to aid in inserting or removing punch die 1 from an automatic punch; on the opposite end, the corresponding hole 10 is used to laterally fix and retain punch die 1.

FIG. 2 is a top view detail of a prior art automatic punch with punch mechanism housing 20 containing punch die 1 as retained laterally by fixed bracket 21 and retaining screw 22. Paper 23 is moved in direction 33 through punch die 1. At the left edge of paper 23 is edge guide 24, left scale 25, left adjuster shaft 26 and left adjuster knob 27. The corresponding right edge components are edge guide 28, scale 29, shaft 30 and knob 31. Thus edge guides 24 and 28 can be used to properly guide paper 23 in direction 33 by providing optimal side forces. These guides are also used to center paper 23 relative to punch die 1, which is fixed laterally in this prior art illustration. Punch die 1 is inserted and removed in the direction shown by arrow 32 by sliding laterally through a die port in the side housing 20 of the automatic punch.

FIG. 3 shows a sheet of paper 40 with a row of round punched holes 41. In FIG. 3, the hole pattern is narrower than pager sheet 40, but it is not centered laterally; here dimension "L", representing the distance between the left side of paper sheet 40 and the left-most hole of holes 41, is smaller than dimension "R", representing the distance between the right side paper sheet 40 and the right-most hole of holes 41. This disparity between side dimensions "L" and "R" is typical of the small misadjustment that usually has to be corrected.

Normally a plurality of punch pins are provided to punch a plurality of holes in the sheets of paper, for example, as shown in FIGS. 3 and 4, along a side edge having a hole pattern for insertion of a fastener, such as a plastic or metal spiral coil of a spiral bound book, or rings of a loose leaf ring binder.

Figure 2A:
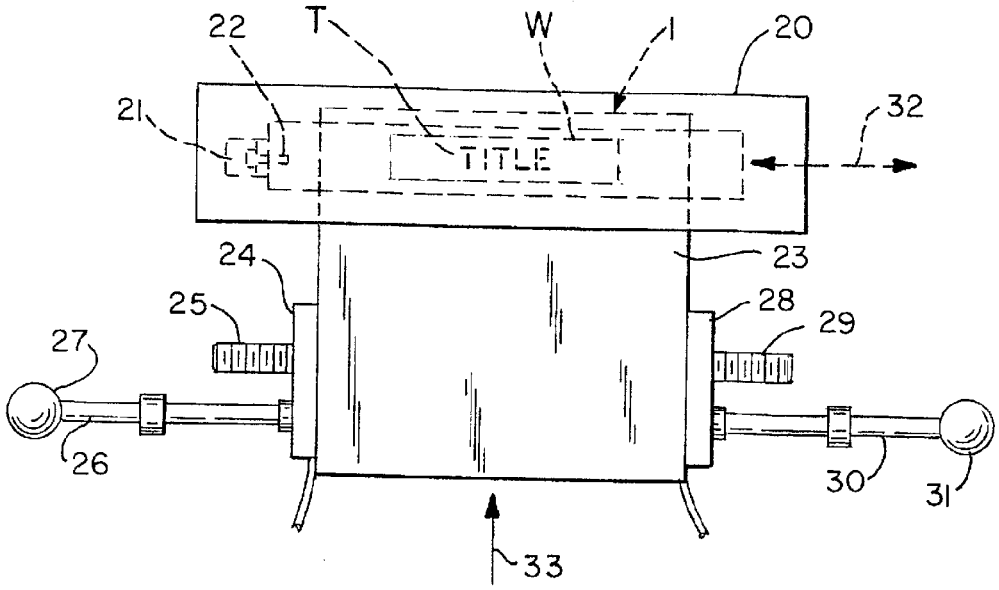
FIG.2A (PRIOR ART)
FIG. 2A is a top plan view detail of a prior art automatic punch for a cover page with a cut-out window to be punched out by a single, large punch pin, showing the relation of the punch die to the paper being punched.

However, as shown in FIG. 2A, the present invention can also be used just for aligning pages together needing a single cover page 23 with a single cut-out window "W" for viewing a title "T" on a sheet of paper 23 underneath the first cover page 23 with the cut-out window "W".

Figure 3A:
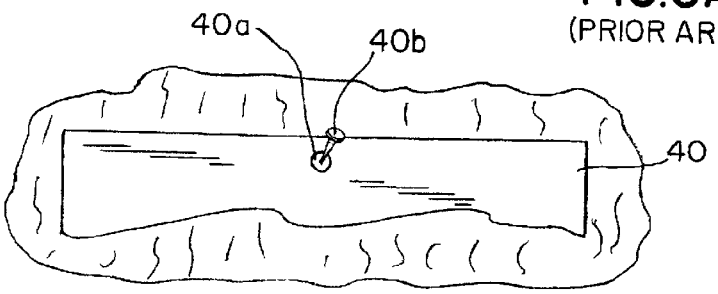
FIG.3A (PRIOR ART)
FIG. 3A is a detail view of a single hole in sheets of paper such as a wall calendar having a hole in the bottom of each month page, for flipping a used calendar month page and hanging the used calendar month page on a calendar holding nail, to expose the next, subsequent calendar month page beneath, wherein the bottom hole is shown at the top of the flipped calendar month page.

Moreover, as shown in FIG. 3A, even a single punch pin can be used to impart a single hole 40*a*, if the sheets of paper 40 are to be held by a single fastener 40*b*. For example, a calendar month page 40 of a wall calendar may have a hole 40*a* in the bottom of each month page for flipping a used calendar month page and hanging the used calendar month page on a fastener such as a calendar holding nail, to expose the next, subsequent calendar month page beneath. FIG. 3A shows a calendar holding nail 40*b* inserted within the bottom hole 40, now at the top of the flipped calendar month page 40.

FIG. 4 shows a pattern of rectangular holes 45 which extend beyond the edge of paper sheet 44. Here dimension "L" representing the distance between the left-most hole of punched holes 45 is larger than dimension "R" representing the distance between the last edge of the right-most holes of holes 45 and the right side of paper sheet 44. With proper lateral alignment, the pattern would look symmetric and dimension "L" should be equal to dimension "R".

Figure 5:
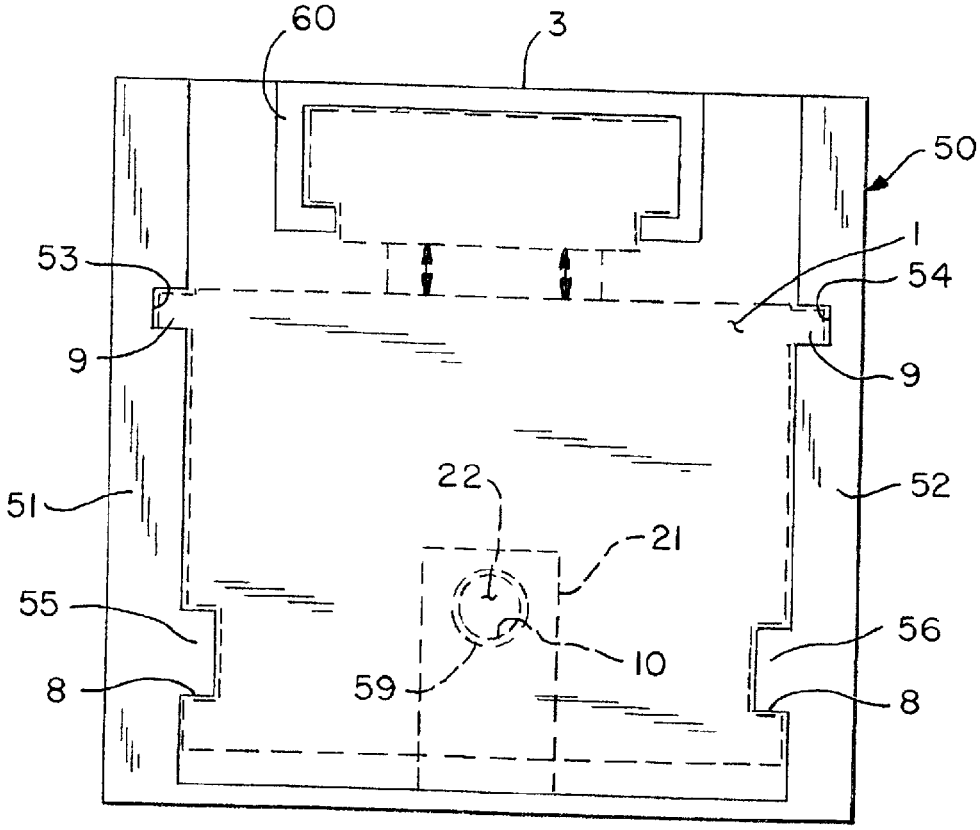
FIG. 5 (PRIOR ART)
FIG. 5 is a side elevational view of the die insertion port at the side of a prior art automatic punch, for insertion of the hole punch die described in FIG. 1 therein.

FIG. 5 shows a side elevational view of hollow die changing port 50 in the side housing of the automatic punch. Recesses 53 and 54 in side channel guides 51 and 52 respectively hold punch die 1 at wings 9. Similarly, protruding bosses 55 and 56 guide and hold die 1 at channel 8. Punch mechanism engagement channel 60 surrounds pin bar/pin holder 3 and reciprocates it up and down to punch holes.

Figure 6:
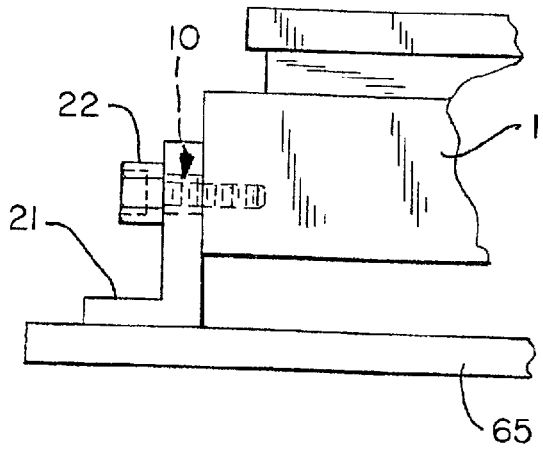
FIG. 6 (PRIOR ART)
FIG. 6 is a side elevational view detail of a prior art fixed die retention.

All of the various engagements retain punch die 1 and prevent it from rotating or moving up or down or sideways. As shown in FIG. 6, it is bracket 21 with bolt 22 inserted through clearance hole 59 and threaded into threaded hole 10 that retains punch die 1 laterally and therefore fixed within the automatic punch however. This is a prior art illustration. For example, FIG. 6 is a side view detail showing the relationship of prior art punch die 1 to bracket 21, machine base 65 and socket head retaining screw 22 in hole 10 as in a prior art system.

In the current invention, bracket 21 is replaced.

Figure 7:
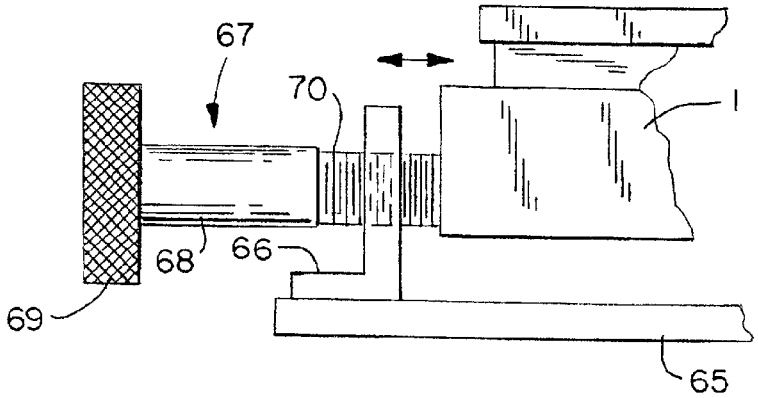
FIG. 7 is a side elevational view detail of the micro adjuster of this invention.

For example, FIG. 7 shows the corresponding view in the current invention, which depicts micro adjuster 67 in place. It includes hollow threaded micro adjuster screw 68, with fine external threads 70 engaged with threaded fixed bracket 66, which is attached closer to the edge of machine base 65. Hollow threaded micro adjuster screw 68 has a knurled hand adjustment wheel 69 at its proximal end and open clearance hole 75 at an opposite distal end. Punch die 1 is attached to the end of screw 68 by retaining screw 22, extending through clearance hole 75 and into punch die 10. For lateral adjustment of punch die 10, hollow threaded micro adjuster 68 is threadably advanced or retracted with respect to threaded fixed bracket 66, thereby changing the position of die 10 with respect to sheet pages 40 or 44, which are depicted in FIGS. 3 and 4 herein.

As punch die 1 is laterally adjusted, punch die 1 is moved in position with respect to sheets of paper 40 or 44 for proper alignment of punch die over sheets of pages 40 or 44 for punching holes therein.

Figure 8:
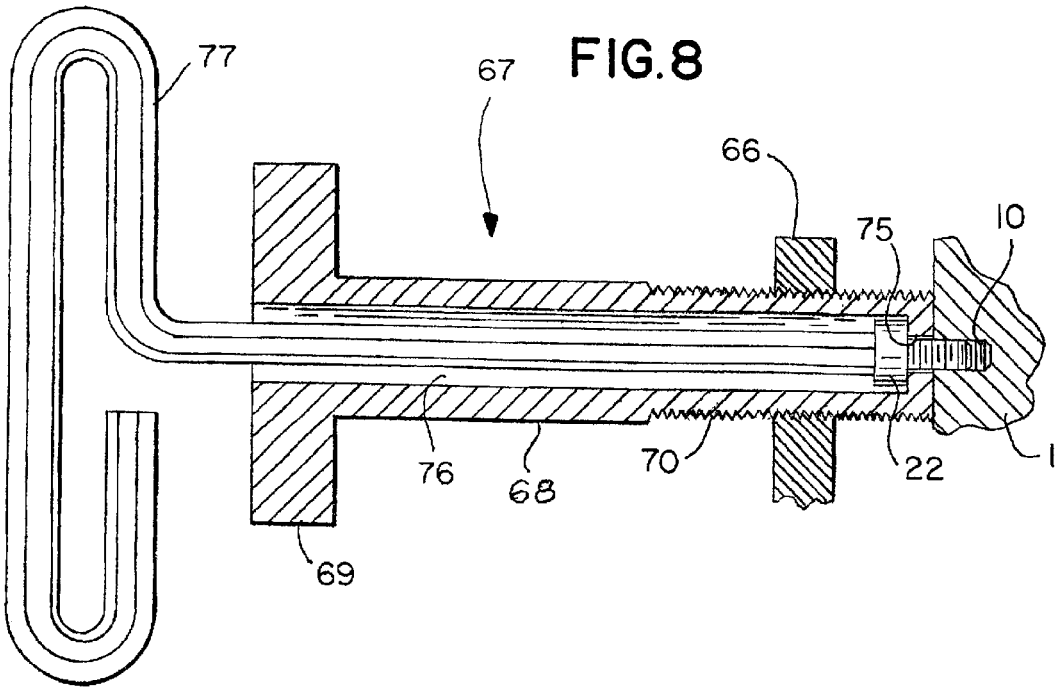
FIG. 8 is a central crossectional side elevational view of the micro adjuster thereof.

FIG. 8 is a crossectional view showing socket head attachment screw 22 emerging from clearance hole 75 at the distal end of micro adjuster screw 68 and engaging with threaded hole 10 in punch die 1. An actuator, such as a long shaft T-handle allen wrench 77, is shown engaged with screw 22 after passing through the hollow center 76 of adjuster screw 68. Allen wrench 77 is used to initially insert screw 22 through adjuster screw 68 to attach die 1 to the end of adjuster screw 68. It is also used to loosen slightly or to tighten screw 22 to permit adjustment of punch die 1 laterally by turning wheel 69. After screw 22 is tightened, punch die 1 is fixed to machine base 65 and micro adjuster screw 68 is prevented from turning.

It is further noted that various modifications may be made to the present invention without departing from the scope of the invention, as noted in the appended Claims.

I claim:

1. A micro adjuster in combination with a paper punch die, said paper punch die having at leant one punch pin capable of punching at least one hole in at least one sheet of paper, wherein said sheet of paper is guided by guides set on either side of the at least one sheet of paper, said guides guiding said at least one sheet of paper properly in a centrally aligned manner through the punching die to a predetermined punching position adjacent to said at least one punch pin, said micro adjuster comprising:

a hollow threaded member laterally movable with respect to a corresponding fixed threaded member;

said hollow threaded member having an axial bore therethrough;

said hollow threaded member having a retaining fastener at a distal end thereof;

said retaining fastener attaching the die to said hollow threaded member;

said retaining fastener movable by an actuator wrench extending through said bore of said hollow threaded member to said retaining fastener;

said hollow threaded member engagable with the die; and, said hollow threaded member, said retaining fastener and the die laterally movable in unison to a predetermined position corresponding to said predetermined punching position of at least one sheet of paper.

2. The micro adjuster as in claim 1 wherein said at least one punch pin is a plurality of punch pins and said at least one hole is a plurality of holes in said at least one sheet of paper.

3. The micro adjuster as in claim 2 wherein said at least one sheet of paper is a plurality of sheets of paper.

4. The micro adjuster as in claim 3 wherein said plurality of holes is row of holes adjacent to an edge of said plurality of sheets of paper, to facilitate binding of said sheets of paper by a mechanical binding inserted therein.

5. The micro adjuster as in claim 4 wherein said mechanical binding is a spiral coil.

6. The micro adjuster as in claim 4 wherein said mechanical binding is a ring of a ring binder.

7. The micro adjuster as in claim 4 wherein said mechanical binding is a fastener.

8. The micro adjuster as in claim 1 wherein said at least one punch pin is a cover window punch pin.

9. The micro adjuster as in claim 1 wherein said fixed threaded member is a fixed end bracket having a threaded hole retaining said hollow threaded member having threads engaged by fine threads of said fixed end bracket, wherein said retaining fastener attaches said die to said hollow threaded member; and, whereby, fine lateral adjustments between the paper sheets to be punched and the punch die can now be performed by moving the punch die laterally.

10. The micro adjuster as in claim 9 wherein said hollow threaded member has outer threads engagable with inner threads of said fixed threaded member.

11. The micro adjuster for a paper punch die as in claim 9 wherein said hollow threaded member has a disk shaped knurled handle on one end of said laterally movable hollow threaded member.

12. The micro adjuster as in claim 9 wherein an actuator wrench is insertable within said axial bore of said hollow threaded member to alternately tighten and untighten said retaining fastener to the punch die.

13. The micro adjuster as in claim 12 wherein said actuator wrench is an Allen wrench engagable with said retaining fastener.

14. The micro adjuster as in claim 12 wherein said retaining fastener emerges through a clearance hole at a distal end of said micro adjuster and engages with a threaded hole in the punch die;

said retaining fastener being alternately tightened and untightened by said actuator turning within said axially aligned bore of said hollow threaded member.

15. The micro adjuster as in claim 1 wherein said at least one sheet of paper is a plurality of calendar month pages and said at least one punch pin is a single pin imparting a single hole in said plurality of calendar month pages at respective bottom edges thereof, for flipping a used calendar month page of said plurality of calendar month pages and hanging said used calendar month page on a calendar holding nail, to expose the next, subsequent calendar month page beneath.

16. A laterally adjustable punch die in combination with a paper punch machine comprising:

a paper punch machine including a punch die having a recess for insertion of multiple sheets of paper therein;

said punch die having a movable punch portion with at least one punch pin punching at least one hole within said multiple sheets of paper;

said multiple sheets of paper being retained in a position for punching of said at least one hole therein by a pair of side guides;

said punch die being laterally movable with respect to a desired punching position against said multiple sheets of paper by a hollow threaded member having outer threads engagable with inner threads of a fixed bracket of said paper punch machine for laterally advancing and retracting said punch die with respect to said desired punching position; and, said hollow threaded member having a bore extending therethrough for insertion of an actuator wrench engaging a retainer fastener fixing said hollow threaded micro adjuster to said punch die.

* * * * *